US012338648B2

(12) United States Patent
Dehlinger

(10) Patent No.: US 12,338,648 B2
(45) Date of Patent: Jun. 24, 2025

(54) MODULAR TENT FLOOR ASSEMBLY

(71) Applicant: Sean Dehlinger, Anthem, AZ (US)

(72) Inventor: Sean Dehlinger, Anthem, AZ (US)

( * ) Notice: Subject to any disclaimer, the term of this patent is extended or adjusted under 35 U.S.C. 154(b) by 415 days.

(21) Appl. No.: 17/982,113

(22) Filed: Nov. 7, 2022

(65) Prior Publication Data

US 2024/0151061 A1 May 9, 2024

(51) Int. Cl.
*E04H 15/56* (2006.01)
*E04F 15/02* (2006.01)

(52) U.S. Cl.
CPC ..... *E04H 15/56* (2013.01); *E04F 15/02183* (2013.01)

(58) Field of Classification Search
CPC .... E04H 15/56; E04F 15/02; E04F 15/02405; E04F 15/02183; E04F 15/02044; E04F 15/02166
USPC ..... 135/116, 908; 404/34, 40, 41, 46; 52/7, 52/177, 263, 403.1
See application file for complete search history.

(56) References Cited

U.S. PATENT DOCUMENTS 2,363,917 A * 11/1944 Waterman ..... E04H 15/008 135/136
2,999,431 A * 9/1961 Mitchell ..... E01C 13/045 404/32
3,657,852 A * 4/1972 Worthington ..... E04F 15/02 52/392
3,771,891 A * 11/1973 Nirenski ..... E01C 13/107 404/40
4,018,025 A * 4/1977 Collette ..... E04F 15/02188 52/302.3
4,287,693 A * 9/1981 Collette ..... B32B 3/06 52/302.1
5,033,241 A 7/1991 Max
D358,191 S 5/1995 November
5,509,244 A * 4/1996 Bentzon ..... E01C 5/005 428/44
5,615,521 A 4/1997 Simerka
5,791,114 A * 8/1998 Mandel ..... E01C 5/20 52/592.1
6,065,264 A * 5/2000 Imler ..... E04H 15/56 52/480
6,148,834 A 11/2000 Grooms, Sr.
6,189,283 B1 * 2/2001 Bentley ..... E04F 15/02 52/587.1
6,802,159 B1 * 10/2004 Kotler ..... E04F 15/02194 52/592.1

(Continued)

FOREIGN PATENT DOCUMENTS

CA 3056246 A1 * 3/2020

*Primary Examiner* — Robert Canfield

(57) ABSTRACT

A modular tent floor assembly for facilitating a flat surface upon which to pitch a tent includes a plurality of floor panels that each has a plurality of fastening elements. Each of the fastening elements on each of the floor panels releasably engages respective fastening elements on a respective floor panel such that the plurality of floor panels defines a floor is positionable on a support surface thereby facilitating a tent to be pitched upon the floor defined by the floor panels. Respective ones of the floor panels has a pair of stake holes extending through the respective floor panels thereby facilitating each of the stake holes to insertably receive a stake for securing the floor defined by the floor panels to the support surface.

16 Claims, 7 Drawing Sheets

(56) References Cited

U.S. PATENT DOCUMENTS 7,360,343 B1 * 4/2008 Spransy ..... E04F 15/02458 52/480
7,516,587 B2 * 4/2009 Barlow ..... E04F 15/105 52/177
7,520,092 B2 * 4/2009 Showers ..... E04F 17/00 52/579
D593,220 S * 5/2009 Reed ..... D25/153
7,797,890 B2 * 9/2010 Thrush ..... E04F 15/10 52/177
7,930,865 B2 * 4/2011 Barlow ..... E04F 15/087 52/741.11
8,001,985 B1 * 8/2011 Conner ..... E04H 15/56 135/96
8,141,314 B2 * 3/2012 Rosan ..... E04F 15/105 52/395
8,215,077 B1 * 7/2012 Dreyer ..... E04F 15/10 52/177
8,683,769 B2 * 4/2014 Cerny ..... E04F 15/02194 52/584.1
8,806,831 B1 * 8/2014 Dreyer ..... E04F 15/02038 52/177
8,833,007 B2 * 9/2014 Tillery ..... E04F 15/22 52/177
9,506,248 B1 * 11/2016 Fields ..... E04H 15/56
9,771,722 B2 * 9/2017 Hurson ..... B32B 37/1284
D880,011 S * 3/2020 Jones ..... D25/138
D895,161 S * 9/2020 Jones ..... D25/138
11,047,137 B1 * 6/2021 Roche ..... E04F 15/02022
11,091,930 B2 8/2021 Grenier
11,280,108 B1 * 3/2022 Szepi ..... A47C 17/64
11,428,015 B2 * 8/2022 Huss ..... E04B 1/34336
11,674,270 B2 * 6/2023 Conrad ..... E01C 11/222 404/34
11,753,776 B2 * 9/2023 Siao ..... E01C 5/20 404/41
2002/0195134 A1 12/2002 Fenech
2003/0093964 A1 * 5/2003 Bushey ..... E04F 15/02 52/459
2006/0010804 A1 * 1/2006 Gray ..... E04F 19/061 52/403.1
2006/0265987 A1 * 11/2006 Iannone ..... E01C 5/20 52/384
2008/0295437 A1 * 12/2008 Dagger ..... E04F 15/02 52/584.1
2009/0250295 A1 10/2009 Laws
2010/0162642 A1 * 7/2010 Allard ..... E04F 15/02172 52/177
2011/0120037 A1 * 5/2011 Barlow ..... E04F 15/105 52/309.1
2012/0192515 A1 * 8/2012 Petta ..... E04F 21/1855 52/302.1
2013/0167458 A1 * 7/2013 Cerny ..... E04F 15/10 52/177
2013/0291457 A1 * 11/2013 Tillery ..... E04F 15/105 52/177
2016/0153202 A1 * 6/2016 Matchung ..... E04F 15/02022 52/220.2
2018/0014529 A1 * 1/2018 Litwin ..... A01M 31/025
2021/0372141 A1 * 12/2021 Osbak ..... E04F 15/02038
2023/0138869 A1 * 5/2023 Lingbloom ..... H05B 1/0275 135/92
2024/0084616 A1 * 3/2024 Wang ..... E06C 5/04
2024/0360632 A1 * 10/2024 Mettler ..... A63H 33/082
2025/0059779 A1 * 2/2025 Armstrong ..... E04G 1/15

* cited by examiner

MODULAR TENT FLOOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to modular floor devices and more particularly pertains to a new modular floor device for facilitating a flat surface upon which to pitch a tent. The device includes a plurality of floor panels that each has fastening elements which engage fastening elements on respective floor panels. In this way the floor panels can be assembled to define a floor upon which a tent can be pitched. Each of the floor panels has a plurality of stake holes for insertably receiving a stake to secure the floor panels to the support surface.

(2) Description of Related Art Including Information Disclosed Under 37 CFR 1.97 and 1.98

The prior art relates to modular floor devices including a foldable dance floor which comprises a panel with a plurality of fold lines. The prior art discloses a tent floor system that includes a pair of inflatable bladder. The prior art discloses a modular tent platform that includes a foraminous panel and a plurality of runners attached to the foraminous panel to support the foraminous panel over a support surface. The prior art discloses a tent platform which includes a flexible sheet, legs attached to the flexible sheet and a plurality of anchors that are extendable through a respective sheet. The prior art discloses a palletized tent platform that includes a plurality of pallets that are slidable together and a plurality of U-shaped clips for attaching the pallets together. The prior art discloses a portable elevated platform that includes a series of decks with foldable legs.

BRIEF SUMMARY OF THE INVENTION

An embodiment of the disclosure meets the needs presented above by generally comprising a plurality of floor panels that each has a plurality of fastening elements. Each of the fastening elements on each of the floor panels releasably engages respective fastening elements on a respective floor panel such that the plurality of floor panels defines a floor is positionable on a support surface thereby facilitating a tent to be pitched upon the floor defined by the floor panels. Respective ones of the floor panels has a pair of stake holes extending through the respective floor panels thereby facilitating each of the stake holes to insertably receive a stake for securing the floor defined by the floor panels to the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

Figure 1:
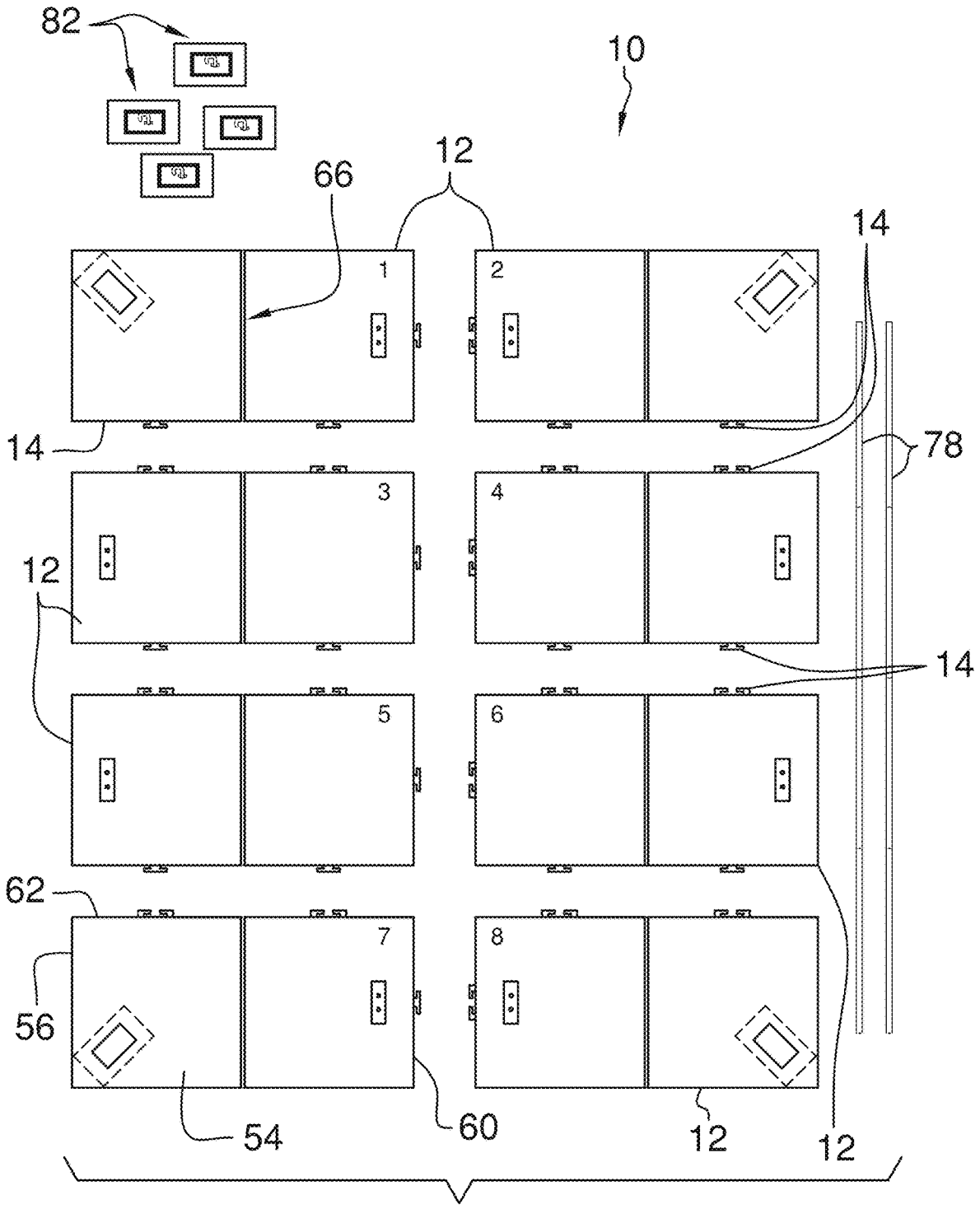
FIG. 1 is a perspective view of a modular tent floor assembly according to an embodiment of the disclosure.
Figure 2:
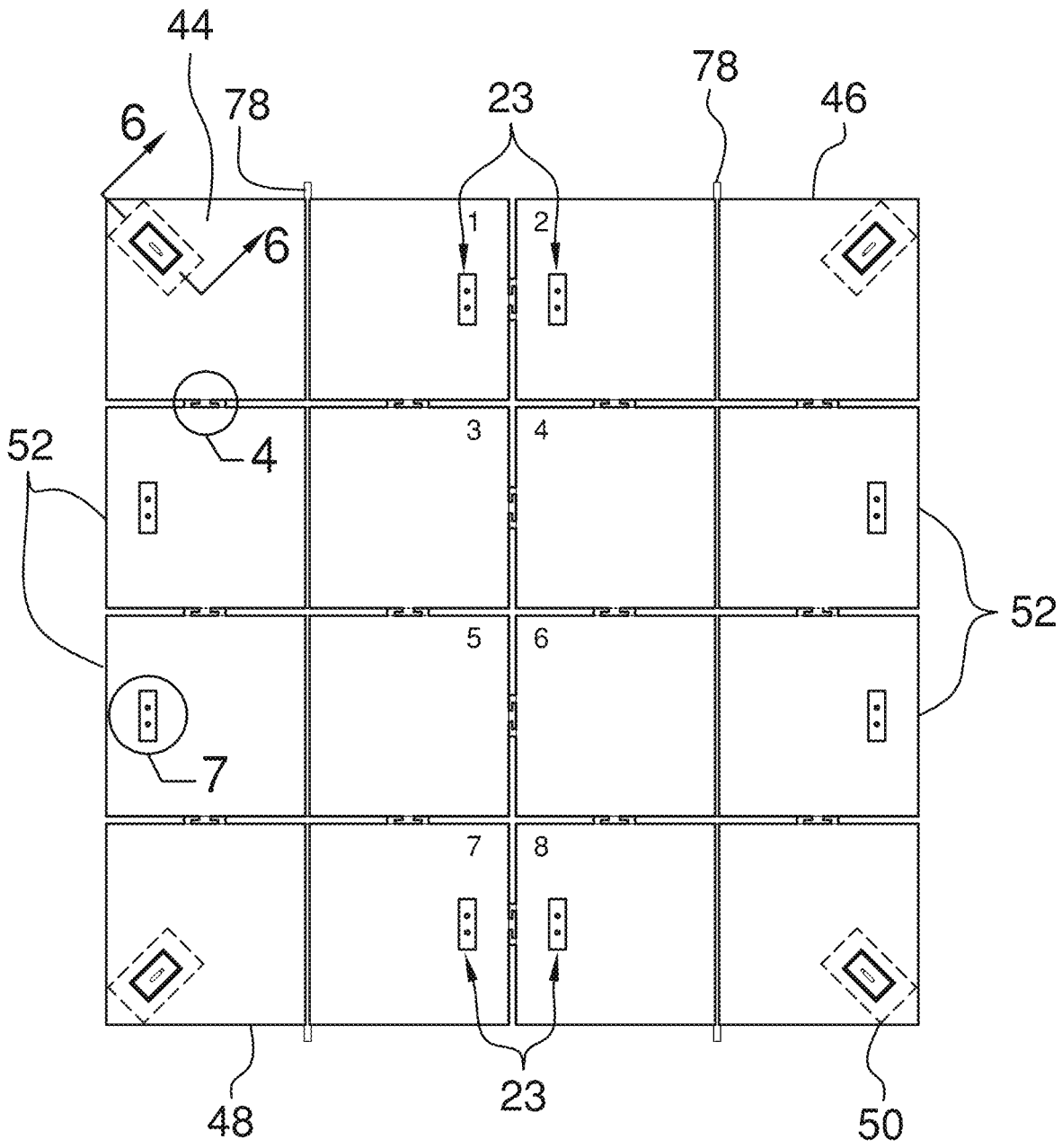
FIG. 2 is a top perspective view of an embodiment of the disclosure showing a plurality of floor panels assembled to define a floor.
Figure 3:
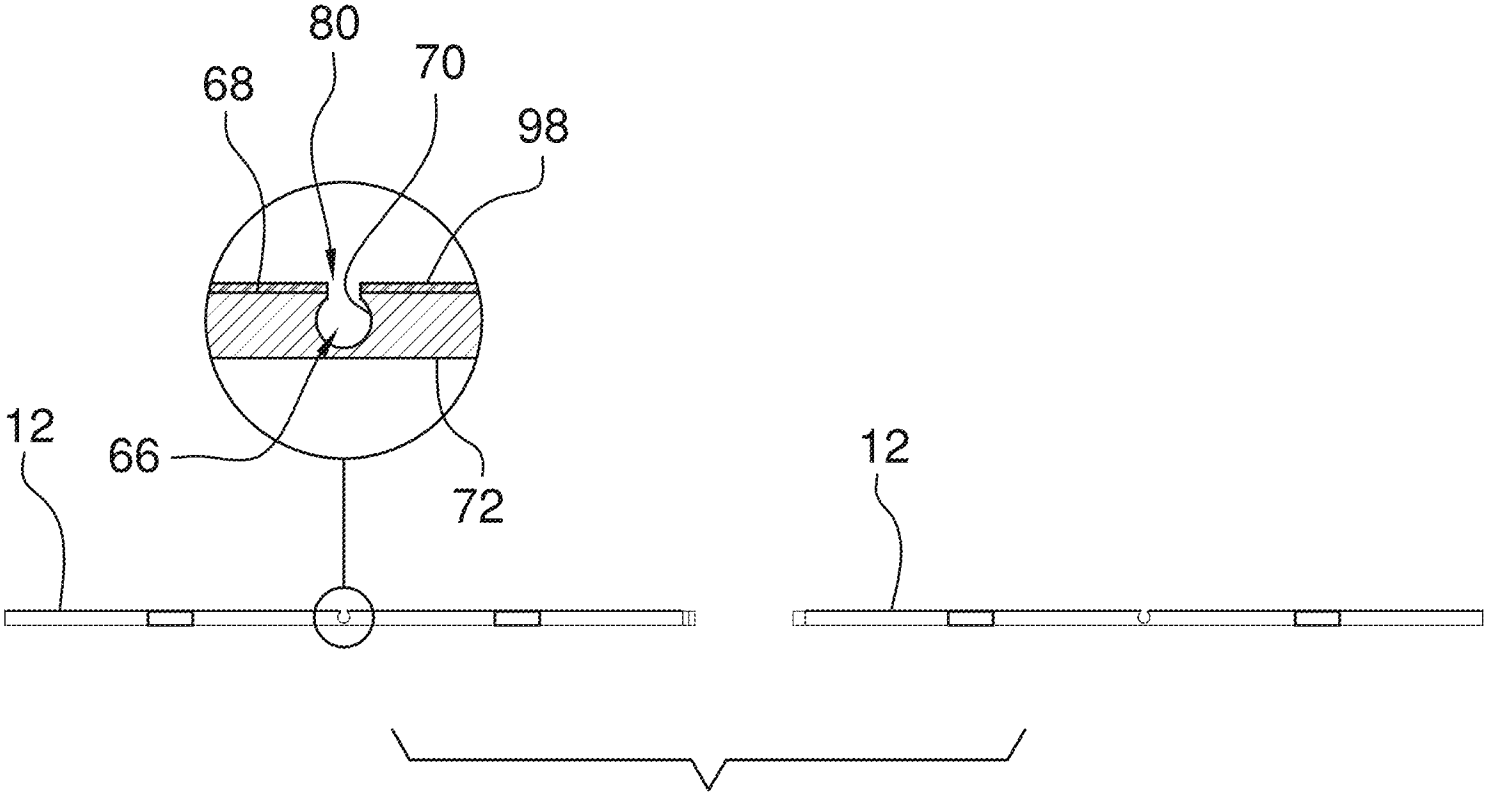
FIG. 3 is a front view of a plurality of floor panels of an embodiment of the disclosure.
Figure 4A:
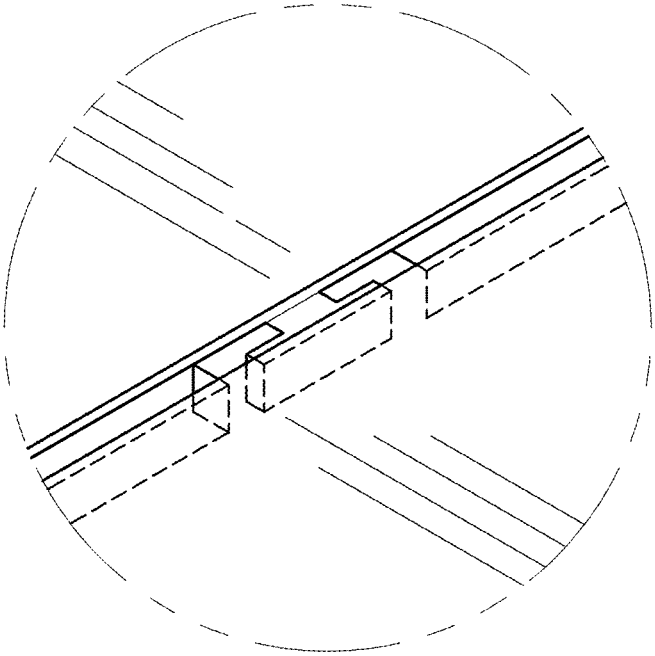

FIG. 4*a* is a detail view of male fastening element being engaged to a female fastening element of an embodiment of the disclosure.

Figure 4B:
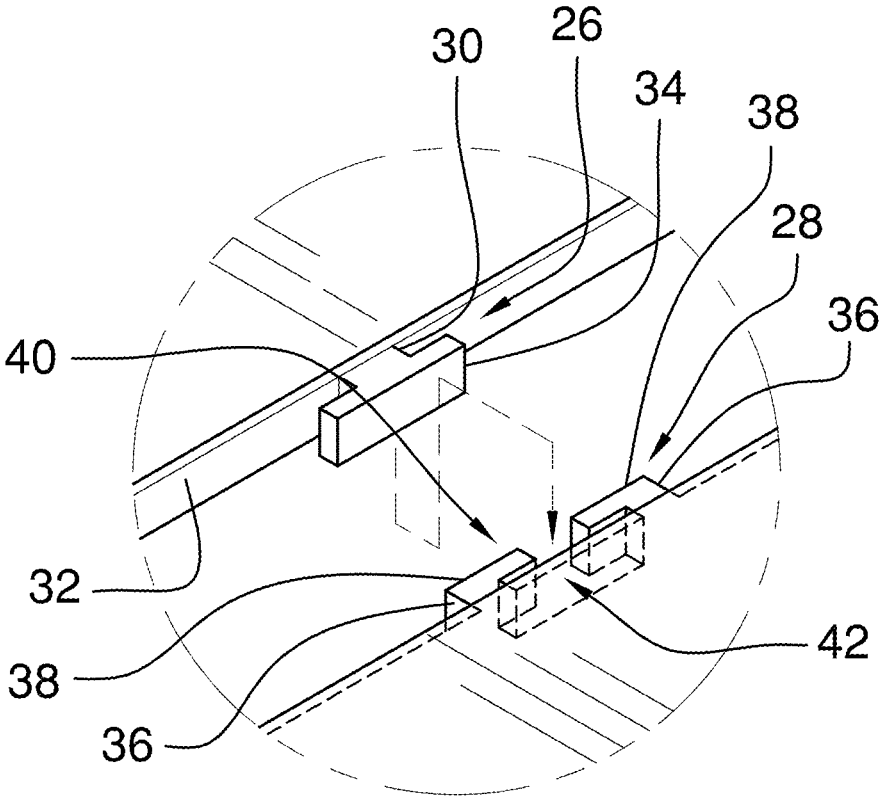

FIG. 4*b* is an exploded detail view of a male fastening element and a female fastening element of an embodiment of the disclosure.

Figure 5:
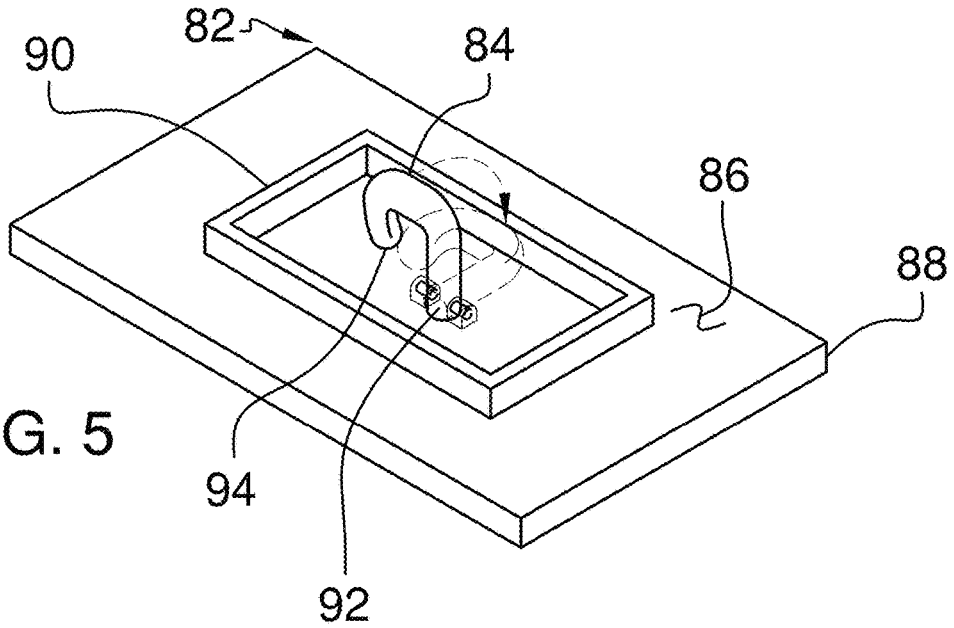

FIG. 5 is a top perspective view of an anchor of an embodiment of the disclosure.

Figure 6:
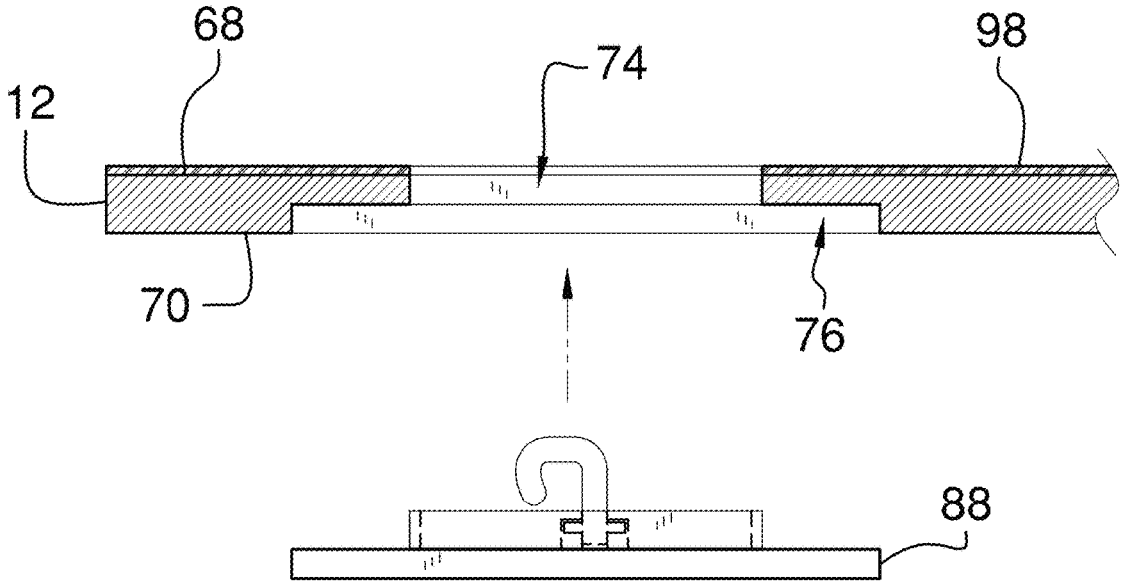

FIG. 6 is a perspective view of an embodiment of the disclosure showing an anchor being inserted into a recess in a floor panel.

Figure 7:
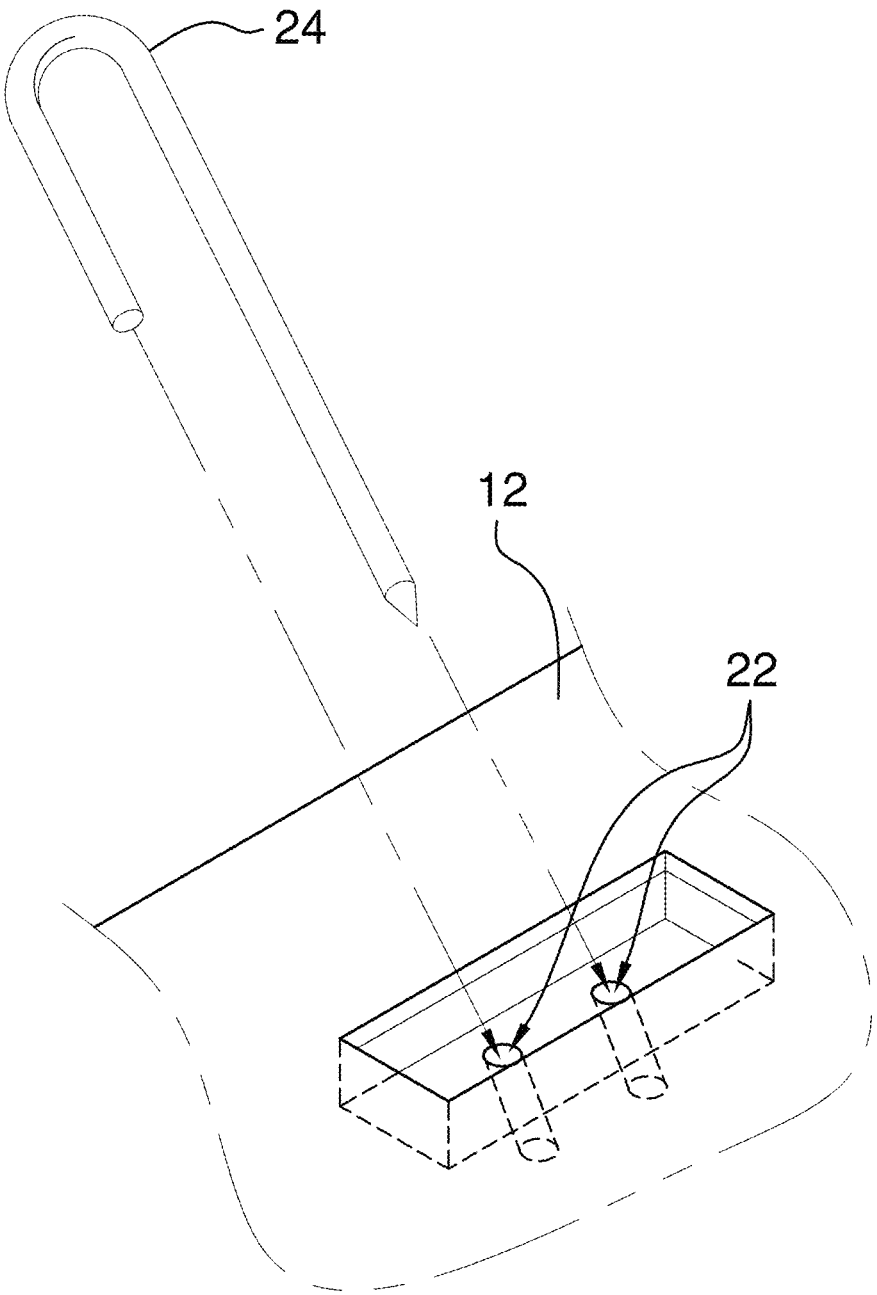

FIG. 7 is a perspective view of an embodiment of the disclosure showing a stake being inserted into a pair of stake holes in a floor panel.

Figure 8:
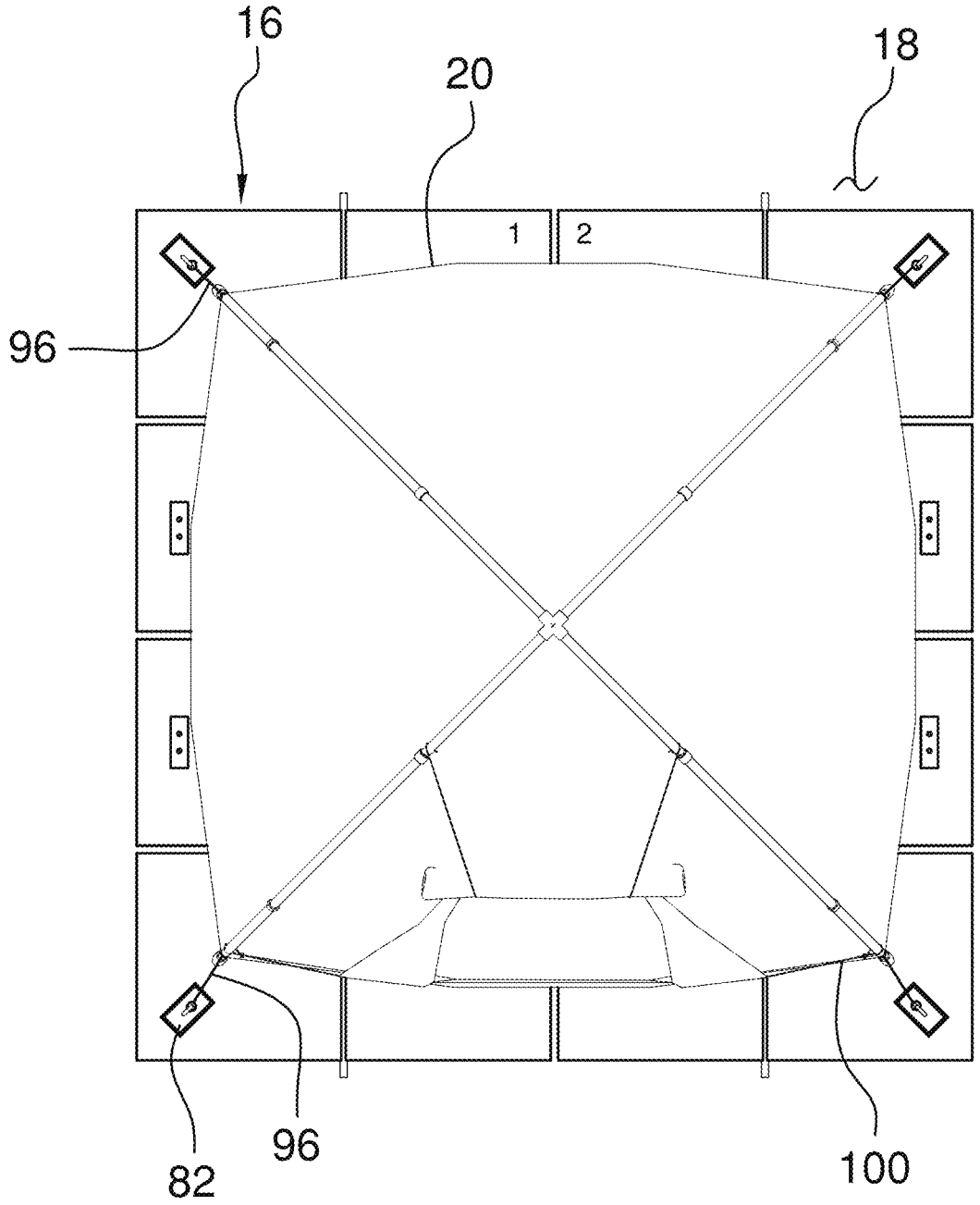

FIG. 8 is a perspective in-use view of an embodiment of the disclosure.

DETAILED DESCRIPTION OF THE INVENTION

With reference now to the drawings, and in particular to FIGS. 1 through 8 thereof, a new modular floor device embodying the principles and concepts of an embodiment of the disclosure and generally designated by the reference numeral 10 will be described.

As best illustrated in FIGS. 1 through 8, the modular tent floor assembly 10 generally comprises a plurality of floor panels 12 that each has a plurality of fastening elements 14. Each of the fastening elements 14 on each of the floor panels 12 releasably engages respective fastening elements 14 on a respective floor panel 12. In this way the plurality of floor panels 12 defines a floor 16 that is positionable on a support surface 18 thereby facilitating a tent 20 to be pitched upon the floor 16 defined by the floor panels 12. The support surface 18 may be ground or other horizontal support surface upon which a tent 20 is typically pitched. Furthermore, the tent 20 may be a camping tent of any conventional size and design. Respective ones of the floor panels 12 has a pair of stake holes 22 extending through the respective floor panels 12 thereby facilitating each of the stake holes 22 to insertably receive a stake 24 for securing the floor 16 defined by the floor panels 12 to the support surface 18. Each of the floor panels 12 may have a length ranging between approximately 50.0 cm and 75.0 cm and width ranging between approximately 40.0 cm and 50.0 cm.

The plurality of fastening elements 14 includes a set of male fastening elements 26 and a set of female fastening elements 28. Each of the male fastening elements 26 comprises a stem 30 extending away from a perimeter edge 32 of a respective one of the floor panels 12 and a head 34 that is transversely oriented with the stem 30 such that the head 34 is spaced from the perimeter edge 32 of the respective floor 16 panel. Each of the female fastening elements 28 comprises a pair of legs 36 each extending away from the perimeter edge 32 of a respective one of the floor panels 12 and a pair of feet 38 each extending away from a respective foot 38. Furthermore, each of the feet 38 is directed toward each other thereby defining a stem space 40 between the feet 38 and a head space 42 between each of the feet 38 and the perimeter edge 32 to which the female fastening elements 28 are attached. Each of the male fastening elements 26 releasably engages a respective female fastening element 28 having the stem 30 being positioned in the stem space 40 and having the head 34 being positioned in the head space 42.

The plurality of floor panels 12 includes a first corner panel 44, a second corner panel 46, a third corner panel 48 and a fourth corner panel 50. Additionally, the plurality of floor panels 12 includes a plurality of middle floor panels 52. A pair of the male fastening elements 26 is disposed on a front side 54 of the perimeter edge 32 of the first corner panel 44 and a single male fastening element 26 is disposed on a first lateral side 56 of the perimeter edge 32 of the first corner panel 44. A single female fastening element 28 is disposed on a second lateral side 60 of the perimeter edge 32 of the second corner panel 46 and a pair of male fastening elements 26 is disposed on the front side 54 of the perimeter edge 32 of the second corner panel 46. The male fastening element 26 on the first lateral side 56 associated with the first corner panel 44 engages the female fastening element 28 on the second lateral side 60 associated with the second corner panel 46.

A pair of the female fastening elements 28 is disposed on a rear side 62 of the perimeter edge 32 of the third corner panel 48 and a single male fastening element 26 is disposed on the first lateral side 56 of the perimeter edge 32 of the third corner panel 48. A single female fastening element 28 is disposed on the second lateral side 60 of the perimeter edge 32 of the fourth corner panel 50 and a pair of female fastening elements 28 is disposed on the rear side 62 of the perimeter edge 32 of the fourth corner panel 50. The male fastening element 26 on the first lateral side 56 associated with the third corner panel 48 engages the female fastening element 28 on the second lateral side 60 associated with the fourth corner panel 50.

A pair of female fastening elements 28 is disposed on the rear side 62 of the perimeter edge 32 of each of the middle floor panels 52 and a pair of male fastening elements 26 is disposed on the front side 54 of the perimeter edge 32 of each of the middle floor panels 52. Each of the male fastening elements 26 on a respective one of the middle floor panels 52 engages respective ones of the female fastening elements 28 on a respective one of the third corner panel 48 and the fourth corner panel 50. Furthermore, each of the female fastening elements 28 on a respective one of the middle floor panels 52 engages respective ones of the male fastening elements 26 on a respective one of the first corner panel 44 and the second corner panel 46. Each of the male fastening elements 26 on each of the middle floor panels 52 that are attached to the first corner panel 44 and the second corner panel 46 engages respective ones of the female fastening elements 28 on each of the middle floor panels 52 that is attached to the third corner panel 48 and the fourth corner panel 50.

Each of the floor panels 12 has a rod slot 66 that is recessed into a top surface 68 of the floor panels 12. The rod slot 66 associated with each of the floor panels 12 extends between the front side 54 and the back side 64 of the perimeter edge 32 of a respective floor 16 panel. Moreover, the rod slot 66 associated with each of the floor panels 12 is centrally positioned between the first lateral side 56 and the second lateral side 60 of the perimeter edge 32 of a respective floor 16 panel. The rod slot 66 in each of the floor panels 12 has a bounding surface 70 that is concavely arcuate with respect to the top surface 68 of the floor panels 12. The rod slot 66 in each of the first corner panel 44 and the third corner panel 48 and respective ones of the middle floor panels 52 is aligned with each other when the respective middle floor panels 52 are attached between the first corner panel 44 and the third corner panel 48. Additionally, the rod slot 66 in each of the second corner panel 46 and the fourth corner panel 50 and respective ones of the middle floor panels 52 is aligned with each other when the receptive middle floor panels 52 are attached between the second corner panel 46 and the fourth corner panel 50.

Each of the stake holes 22 extends through the top surface 68 and a bottom surface 72 of a respective one of the floor panels 12 and each of the stake holes 22 is angled between the top surface 68 and the bottom surface 72. The plurality of stake holes 22 includes a plurality of sets of the stake holes 23 and respective ones of the sets of stake holes 23 are positioned adjacent to the first lateral side 56 associated with respective ones of the middle floor panels 52. Respective ones of the sets of stake holes 23 are positioned adjacent to the second lateral side 60 associated with respective ones of the middle floor panels 52. Continuing, respective ones of the sets of stake holes 23 are positioned adjacent to the second lateral side 60 associated with the second corner panel 46 and the fourth corner panel 50. Respective ones of the sets of stake holes 23 are positioned adjacent to the second lateral side 60 associated the first corner panel 44 and the third corner panel 48. As is most clearly shown in FIG. 7, the stakes 24 that are extended through the stake holes 22 may comprise a J-shaped stake such that the J-shaped stake extends across the top surface 68 of the respective floor 16 panel when the J-shaped stake is inserted through the stake holes 22.

Each of the first corner panel 44, the second corner panel 46, the third corner panel 48 and the fourth corner panel 50 has an opening 74 extending through the top surface 68 and the bottom surface 72 of the first corner panel 44, the second corner panel 46, the third corner panel 48 and the fourth corner panel 50. The opening 74 in each of the first corner panel 44 and the third corner panel 48 is elongated to extend along a line bisecting a right angle defined between first lateral side 56 and the front side 54 associated with the first corner panel 44 and the third corner panel 48. Additionally, the opening 74 in each of the first corner panel 44 and the third corner panel 48 is positioned adjacent to the right angle. The opening 74 in each of the second corner panel 46 and the fourth corner panel 50 is elongated to extend along a line bisecting a right angle defined between the second lateral side 60 and the front side 54 associated with the second corner panel 46 and the fourth corner panel 50. Furthermore, the bottom surface 72 of each of the first corner panel 44, the second corner panel 46, the third corner panel 48 and the fourth corner panel 50 has a recess 76 surrounding the opening 74.

A pair of rods 78 is provided and a respective one of the rods 78 is insertable into the rod slot 66 in each of the first corner panel 44 and the third corner panel 48 and the middle floor panels 52 that are positioned between the first corner panel 44 and the third corner panel 48. Additionally, a respective one of the rods 78 is insertable into the rod slot 66 in each of the second corner panel 46 and the fourth corner panel 50 and the middle floor panels 52 that are positioned between the second corner panel 46 and the fourth corner panel 50. Each of the rods 78 is comprised of a rigid material thereby enhancing rigidity of the plurality of floor panels 12 when the rods 78 are slid into respective rod slots 66. As is most clearly shown in FIG. 3, an entrance 80 into each of the rod slots 66 has a width that is less than a diameter of the rod slots 66. In this way the rod 78 in each of the rod slots 66 is inhibited from being lifted upwardly out of the rod slots 66.

A plurality of anchors 82 is provided and each of the anchors 82 includes a hook 84 that is pivotally coupled to an upper surface 86 of an anchor panel 88. The upper surface 86 of the anchor panel 88 has a ridge 90 surrounding the hook 84. The anchor panel 88 of each of the anchors 82 is insertable into recess 76 in the in the bottom surface 72 of a respective one of the floor panels 12 such that the ridge 90 extends upwardly through the opening 74 in the respective floor panel 12. In this way the hook 84 is exposed with respect to the top surface 68 of the respective floor panel 12.

The hook 84 associated with each of the anchors 82 has a lower end 92 that is pivotally attached to the upper surface 86 of the anchor panel 88. Additionally, the hook 84 associated with each of the anchors 82 is curved between the lower end 92 and an upper end 94 of the hook 84. The upper end 94 of the hook 84 is directed toward the upper surface 86 of the anchor panel 88 when the hook 84 is positioned in a deployed position thereby facilitating a tie down line 96 of the tent 20 to be secured to the hook 84. A plurality of pads 98 is provided and each of the pads 98 is bonded to the top surface 68 of a respective one of the floor panels 12. Each of the pads 98 is comprised of a resiliently compressible material to enhance comfort for lying in the tent 20 when the tent 20 is pitched on the floor panels 12.

In use, the floor panels 12 are assembled in the aforementioned process to define the floor 16. Each of the anchors 82 is positioned in a respective recess 76 and each of the rods 78 is slid into the respective rod slots 66. Furthermore, the stakes 24 are inserted through respective stake holes 22 to secure the floor 16 to the support surface 18. The tent 20 is pitched on top of the floor 16 and the tie down lines 96 for the tent 20 are secured to the hook 84 on a respective one of the anchors 82. In this way the a bottom 100 of the tent 20 rests on top of the floor 16, rather than on the support surface 18, thereby inhibiting the bottom 100 of the tent 20 from being damaged by rocks and debris on the support surface 18. Additionally, the pad 98 on each of the floor panels 12 enhances comfort for lying in the tent 20 while sleeping.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular tent floor assembly for facilitating a tent to be pitched on a stable floor, said assembly comprising:

a plurality of floor panels, each of said floor panels having a plurality of fastening elements, each of said fastening elements on each of said floor panels releasably engaging respective fastening elements on a respective floor panel such that said plurality of floor panels defines a floor being positionable on a support surface thereby facilitating a tent to be pitched upon said floor defined by said floor panels, respective ones of said floor panels having a pair of stake holes extending through said respective floor panels thereby facilitating each of said stake holes to insertably receive a stake for securing said floor defined by said floor panels to the support surface; and wherein each of said floor panels has a rod slot being recessed into a top surface of said floor panels, said rod slot associated with each of said floor panels extending between a front side and a back side of a perimeter edge of a respective floor panel, said rod slot associated with each of said floor panels being centrally positioned between said first lateral side and said second lateral side of said perimeter edge of a respective floor panel, said rod slot in each of said floor panels having a bounding surface being concavely arcuate with respect to said top surface of said floor panels.

2. The assembly according to claim 1, wherein:

said plurality of floor panels includes a first corner panel and a second corner panel and a third corner panel and a fourth corner panel and a plurality of middle floor panels;

said rod slot in each of said first corner panel and said third corner panel and respective ones of said middle floor panels being aligned with each other when said respective middle floor panels are attached between said first corner panel and said third corner panel; and said rod slot in each of said second corner panel and said fourth corner panel and respective ones of said middle corner panels being aligned with each other when said receptive middle floor panels are attached between said second corner panel and said fourth corner panel.

3. The assembly according to claim 1, wherein:

said plurality of floor panels includes a first corner panel and a second corner panel and a third corner panel and a fourth corner panel and a plurality of middle floor panels;

each of said stake holes extends through a top surface and a bottom surface of a respective one of said floor panels, each of said stake holes being angled between said top surface and said bottom surface;

said plurality of stake holes includes a plurality of sets of said stake holes;

respective ones of said sets of stake holes is positioned adjacent to a first lateral side associated with respective ones of said middle floor panels;

respective ones of said sets of stake holes is positioned adjacent to said second lateral side associated with respective ones of said middle floor panels;

respective ones of said sets of stake holes is positioned adjacent to said second lateral side associated with said second corner panel and said fourth corner panel; and respective ones of said sets of stake holes is positioned adjacent to said second lateral side associated said first corner panel and said third corner panel.

4. The assembly according to claim 1, further comprising a pair of rods, a respective one of said rods being insertable into said rod slot in each of said first corner panel and said third corner panel and said middle floor panels that are positioned between said first corner panel and said third corner panel, a respective one of said rods being insertable into said rod slot in each of said second corner panel and said fourth corner panel and said middle floor panels that are positioned between said second corner panel and said fourth corner panel, each of said rods being comprised of a rigid material thereby enhancing rigidity of said plurality of floor panels when said rods are slid into respective rod slots.

5. The assembly according to claim 1, further comprising a plurality of pads, each of said pads being bonded to a top surface of a respective one of said floor panels, each of said pads being comprised of a resiliently compressible material wherein each of said pads is configured to enhance comfort for lying in the tent when the tent is pitched on said floor panels.

6. The assembly according to claim 1, further comprising:

said plurality of fastening elements including a set of male fastening elements and a set of female fastening elements, each of said male elements comprising a stem extending away from a perimeter edge of a respective one of said floor panels and a head being transversely oriented with said stem such that said head is spaced from said perimeter edge of said respective floor panel, each of said female fastening elements comprising a pair of legs each extending away from said perimeter edge of a respective one of said floor panels and a pair of feet each extending away from a respective foot, each of said feet being directed toward each other thereby defining a stem space between said feet and a head space between each of said feet and said perimeter edge to which said female fastening elements are attached, each of said male fastening elements releasably engaging a respective female fastening element having said stem being positioned in said stem space and having said head being positioned in said head space, said plurality of floor panels including a first corner panel and a second corner panel and a third corner panel and a fourth corner panel, said plurality of floor panels including a plurality of middle floor panels, a pair of said male fastening elements being disposed on a front side of said perimeter edge of said first corner panel, a single male fastening element being disposed on a first lateral side of said perimeter edge of said first corner panel, a single female fastening element being disposed on a second lateral side of said perimeter edge of said second corner panel, a pair of male fastening elements being disposed on a front side of said perimeter edge of said second corner panel, said male fastening element on said first lateral side associated with said first corner panel engaging said female fastening element on said second lateral side associated with said second corner panel, a pair of said female fastening elements being disposed on a rear side of said perimeter edge of said third corner panel, a single male fastening element being disposed on a first lateral side of said perimeter edge of said third corner panel, a single female fastening element being disposed on a second lateral side of said perimeter edge of said fourth corner panel, a pair of female fastening elements being disposed on a rear side of said perimeter edge of said fourth corner panel, said male fastening element on said first lateral side associated with said third corner panel engaging said female fastening element on said second lateral side associated with said fourth corner panel, a pair of female fastening elements being disposed on a back side of said perimeter edge of each of said middle floor panels, a pair of male fastening elements being disposed on a front side of said perimeter edge of each of said middle floor panels, each of said male fastening elements on a respective one of said middle floor panels engaging respective ones of said female fastening elements on a respective one of said third corner panel and said fourth corner panel, each of said female fastening elements on a respective one of said middle floor panels engaging respective ones of said male fastening elements on a respective one of said first corner panel and said second corner panel, each of said male fastening elements on each of said middle floor panels being attached to said first corner panel and said second corner panel engaging respective ones of said female fastening elements on each of said middle floor panels being attached to said third corner panel and said fourth corner panel, said rod slot in each of said floor panels having a bounding surface being concavely arcuate with respect to said top surface of said floor panels; said rod slot in each of said first corner panel and said third corner panel and respective ones of said middle floor panels being aligned with each other when said respective middle floor panels are attached between said first corner panel and said third corner panel, said rod slot in each of said second corner panel and said fourth corner panel and respective ones of said middle corner panels being aligned with each other when said receptive middle floor panels are attached between said second corner panel and said fourth corner panel, each of said stake holes extending through a top surface and a bottom surface of a respective one of said floor panels, each of said stake holes being angled between said top surface and said bottom surface, said plurality of stake holes including a plurality of sets of said stake holes, respective ones of said sets of stake holes being positioned adjacent to said first lateral side associated with respective ones of said middle floor panels, respective ones of said sets of stake holes being positioned adjacent to said second lateral side associated with respective ones of said middle floor panels, respective ones of said sets of stake holes being positioned adjacent to said second lateral side associated with said second corner panel and said fourth corner panel, respective ones of said sets of stake holes being positioned adjacent to said second lateral side associated said first corner panel and said third corner panel, each of said first corner panel and said second corner panel and said third corner panel and said fourth corner panel having an opening extending through said top surface and said bottom surface of said first corner panel and said second corner panel and said third corner panel and said fourth corner panel, said opening in each of said first corner panel and said third corner panel being elongated to extend along a line bisecting a right angle defined between first lateral side and said front side associated with said first corner panel and said third corner panel, said opening in each of said first corner panel and said third corner panel being positioned adjacent to said right angle, said opening in each of said second corner panel and said fourth corner panel being elongated to extend along a line bisecting a right angle defined between said second lateral side and said front side associated with said second corner panel and said fourth corner panel, said bottom surface of each of said first corner panel and said second corner panel and said third corner panel and said fourth corner panel having a recess surrounding said opening;

a pair of rods, a respective one of said rods being insertable into said rod slot in each of said first corner panel and said third corner panel and said middle floor panels that are positioned between said first corner panel and said third corner panel, a respective one of said rods being insertable into said rod slot in each of said second corner panel and said fourth corner panel and said middle floor panels that are positioned between said second corner panel and said fourth corner panel, each of said rods being comprised of a rigid material thereby enhancing rigidity of said plurality of floor panels when said rods are slid into respective rod slots; and a plurality of anchors, each of said comprising a hook being pivotally coupled to an upper surface of an anchor panel, said upper surface of said anchor panel having a ridge surrounding said hook, said anchor panel of each of said anchors being insertable into recess in said in said bottom surface of a respective one of said floor panels such that said ridge extends upwardly through said opening in said respective floor panel thereby facilitating said hook to be exposed with respect to said top surface of said respective floor panel, said hook associated with each of said anchors having a lower end being pivotally attached to said upper surface of said anchor panel, said hook associated with each of said anchors being curved between said lower end and a upper end of said hook, said upper end of said hook being directed toward said upper surface of said anchor panel when said hook is positioned in a deployed position thereby facilitating a tie down line of the tent to be secured to said hook; and a plurality of pads, each of said pads being bonded to said top surface of a respective one of said floor panels, each of said pads being comprised of a resiliently compressible material wherein each of said pads is configured to enhance comfort for lying in the tent when the tent is pitched on said floor panels.

7. A modular tent floor assembly for facilitating a tent to be pitched on a stable floor, said assembly comprising:

a plurality of floor panels, each of said floor panels having a plurality of fastening elements, each of said fastening elements on each of said floor panels releasably engaging respective fastening elements on a respective floor panel such that said plurality of floor panels defines a floor being positionable on a support surface thereby facilitating a tent to be pitched upon said floor defined by said floor panels, respective ones of said floor panels having a pair of stake holes extending through said respective floor panels thereby facilitating each of said stake holes to insertably receive a stake for securing said floor defined by said floor panels to the support surface;

wherein said plurality of fastening elements includes a set of male fastening elements and a set of female fastening elements;

wherein each of said male elements comprises a stem extending away from a perimeter edge of a respective one of said floor panels and a head being transversely oriented with said stem such that said head is spaced from said perimeter edge of said respective floor panel;

wherein each of said female fastening elements comprises a pair of legs each extending away from said perimeter edge of a respective one of said floor panels and a pair of feet each extending away from a respective foot, each of said feet being directed toward each other thereby defining a stem space between said feet and a head space between each of said feet and said perimeter edge to which said female fastening elements are attached; and wherein each of said male fastening elements releasably engaging a respective female fastening element having said stem being positioned in said stem space and having said head being positioned in said head space.

8. The assembly according to claim 7, wherein:

said plurality of floor panels includes a first corner panel and a second corner panel and a third corner panel and a fourth corner panel;

a pair of said male fastening elements is disposed on a front side of said perimeter edge of said first corner panel; and a single male fastening element is disposed on a first lateral side of said perimeter edge of said first corner panel.

9. The assembly according to claim 8, wherein:

a single female fastening element is disposed on a second lateral side of said perimeter edge of said second corner panel;

a pair of male fastening elements is disposed on a front side of said perimeter edge of said second corner panel; and said male fastening element on said first lateral side associated with said first corner panel engages said female fastening element on said second lateral side associated with said second corner panel.

10. The assembly according to claim 8, wherein;

a pair of said female fastening elements is disposed on a rear side of said perimeter edge of said third corner panel;

a single male fastening element is disposed on a first lateral side of said perimeter edge of said third corner panel.

11. The assembly according to claim 10, wherein:

a single female fastening element is disposed on a second lateral side of said perimeter edge of said fourth corner panel;

a pair of female fastening elements is disposed on a rear side of said perimeter edge of said fourth corner panel; and said male fastening element on said first lateral side associated with said third corner panel engages said female fastening element on said second lateral side associated with said fourth corner panel.

12. The assembly according to claim 11, wherein:

said plurality of floor panels includes a plurality of middle floor panels;

a pair of female fastening elements is disposed on a back side of said perimeter edge of each of said middle floor panels;

a pair of male fastening elements is disposed on a front side of said perimeter edge of each of said middle floor panels; and each of said male fastening elements on a respective one of said middle floor panels engages respective ones of said female fastening elements on a respective one of said third corner panel and said fourth corner panel.

13. The assembly according to claim 12, wherein;

each of said female fastening elements on a respective one of said middle floor panels engages respective ones of said male fastening elements on a respective one of said first corner panel and said second corner panel; and each of said male fastening elements on each of said middle floor panels attached to said first corner panel and said second corner panel engages respective ones of said female fastening elements on each of said middle floor panels being attached to said third corner panel and said fourth corner panel.

14. A modular tent floor assembly for facilitating a tent to be pitched on a stable floor, said assembly comprising:

a plurality of floor panels, each of said floor panels having a plurality of fastening elements, each of said fastening elements on each of said floor panels releasably engaging respective fastening elements on a respective floor panel such that said plurality of floor panels defines a floor being positionable on a support surface thereby facilitating a tent to be pitched upon said floor defined by said floor panels, respective ones of said floor panels having a pair of stake holes extending through said respective floor panels thereby facilitating each of said stake holes to insertably receive a stake for securing said floor defined by said floor panels to the support surface;

wherein said plurality of floor panels includes a first corner panel and a second corner panel and a third corner panel and a fourth corner panel;

wherein each of said first corner panel and said second corner panel and said third corner panel and said fourth corner panel has an opening extending through said top surface and said bottom surface of said first corner panel and said second corner panel and said third corner panel and said fourth corner panel;

wherein said opening in each of said first corner panel and said third corner panel being elongated to extend along a line bisecting a right angle defined between first lateral side and said front side associated with said first corner panel and said third corner panel;

wherein said opening in each of said first corner panel and said third corner panel being positioned adjacent to said right angle;

wherein said opening in each of said second corner panel and said fourth corner panel being elongated to extend along a line bisecting a right angle defined between said second lateral side and said front side associated with said second corner panel and said fourth corner panel; and wherein said bottom surface of each of said first corner panel and said second corner panel and said third corner panel and said fourth corner panel has a recess surrounding said opening.

15. The assembly according to claim 14, further comprising a plurality of anchors, each of said comprising a hook being pivotally coupled to an upper surface of an anchor panel, said upper surface of said anchor panel having a ridge surrounding said hook, said anchor panel of each of said anchors being insertable into recess in said in said bottom surface of a respective one of said floor panels such that said ridge extends upwardly through said opening in said respective floor panel thereby facilitating said hook to be exposed with respect to said top surface of said respective floor panel.

16. The assembly according to claim 15, wherein said hook associated with each of said anchors has a lower end being pivotally attached to said upper surface of said anchor panel, said hook associated with each of said anchors being curved between said lower end and a upper end of said hook, said upper end of said hook being directed toward said upper surface of said anchor panel when said hook is positioned in a deployed position thereby facilitating a tie down line of the tent to be secured to said hook.

* * * * *